US011571702B1

(12) United States Patent
Taylor

(10) Patent No.: US 11,571,702 B1
(45) Date of Patent: Feb. 7, 2023

(54) CAP FOR FLUID DISPENSER

(71) Applicant: Robert Taylor, Cathedral City, CA (US)

(72) Inventor: Robert Taylor, Cathedral City, CA (US)

( * ) Notice: Subject to any disclaimer, the term of this patent is extended or adjusted under 35 U.S.C. 154(b) by 0 days.

(21) Appl. No.: 17/409,475

(22) Filed: Aug. 23, 2021

Related U.S. Application Data

(60) Provisional application No. 63/081,445, filed on Sep. 22, 2020.

(51) Int. Cl.
*B05B 11/00* (2006.01)

(52) U.S. Cl.
CPC ..... *B05B 11/0032* (2013.01)

(58) Field of Classification Search
CPC ..... B05B 11/0032
See application file for complete search history.

(56) References Cited

U.S. PATENT DOCUMENTS 4,353,483 A * 10/1982 Pehr ..... B65D 83/226 220/915
5,447,255 A * 9/1995 Smedley ..... B65D 47/286 222/102
7,044,339 B1 * 5/2006 Kuo ..... B05B 11/3059 222/321.9
2008/0245896 A1 * 10/2008 Welp ..... A61M 15/08 222/321.6
2009/0188946 A1 * 7/2009 Chien ..... B05B 11/0089 222/321.3
2010/0018997 A1 * 1/2010 Faneca ..... B05B 11/0032 222/153.07

* cited by examiner

*Primary Examiner* — Jeremy Carroll
(74) *Attorney, Agent, or Firm* — Averill & Green; Kenneth L. Green

(57) ABSTRACT

A chemical resistant elastomeric cap that can be secured to the head of a pump type liquid dispenser with a delivery nozzle that can be used to seal off the dispenser nozzle to prevent fluid dripping from the end of the nozzle and to prevent air from reaching the end of the nozzle to dry fluid in the nozzle outlet orifice and/or the nozzle tip. The cap is one piece and has an attachment ring of elastomeric material than can to fitted around the dispenser head to retain the cap with the dispenser and the attach bottle whether the cap is fitted over the nozzle or free from the nozzle.

20 Claims, 3 Drawing Sheets

CAP FOR FLUID DISPENSER

STATEMENT REGARDING PRIOR DISCLOSURES BY THE INVENTOR

PROVISIONAL APPLICATION Ser. No. 63/081,445 (Filed Sep. 22, 2020)

This Patent Application claims priority on Provisional Application Ser. No. 63/081,445 entitled: Cap for Fluid Dispenser filed on Sep. 22, 2020

The inventor filed an earlier provisional application on Mar. 7, 2010 disclosing a related invention. A full patent application was not filed claiming priority on the provisional application. The inventor has disclosed the invention to necessary parties for the development of his invention. All such disclosures have been under confidentiality agreements.

FIELD OF THE INVENTION

The present invention is directed to a cap for the delivery nozzle of liquid pump type dispensers.

BACKGROUND OF THE INVENTION

Fluid materials, such as hand soaps, waterless hand cleaner, aqueous based cleansers, bath soaps, body lotions, skin lotions, moisturizing lotions, shampoos, liquid detergents, sanitizing solutions, dishwashing soaps and solutions, aftershave lotions, hair cleaner solutions, hair shampoos, hair conditioners, and the like, are frequently dispensed with pump action liquid dispensers. The dispenser is attached to the top of a storage bottle for the fluid material. The head or top of the dispenser is depressed or pumped down to pump the desired fluid out of the bottle storing the fluid. The pumped fluid is drawn up through a tube, such as a flexible plastic tube extending from the dispenser, which extends into the fluid in the bottle. The fluid passes through the dispenser pump and passes through the dispenser and the dispenser nozzle and out through the dispenser's orifice located at the end of the dispenser's nozzle which extends out from the dispenser head.

The dispenser has a pump. A portion of the pump of the dispenser resides outside the storage bottle and the other portion of the pump, resides in the bottle containing the fluid. The hollow long tube described above is connected to the dispenser pump and extends down from the dispenser towards the bottom of the bottle. The tube does not extend fully down to the bottom of the bottle. The end of the tube is spaced generally about ⅛ to ¼ inch from the bottom of the bottle so that the end of the tube is fully exposed or open to the fluid. The dispenser pump is actuated by pumping down or depressing the dispenser head which resides directly above the pump but is positioned outside the bottle. The delivery nozzle or nozzle for the pumped fluid extends horizontally outward from the dispenser head. The pumped fluid is pumped or drawn up through the hollow long tube by partial suction and then through the pump, into the dispenser head and through the nozzle. The pumped fluid flows under pressure from the dispenser pump out through the delivery orifice or orifice at the free end of the nozzle. Such dispensers are very convenient and very reliable and are used extensively. Surprisingly although dispensers are made by several manufacturers, they are similar in shape and size. The dispenser's nozzle extends out generally horizontally from the dispenser head or top. Some nuzzles are angled downward or upward to a slight degree.

The fluid is pumped from the storage container, through the dispenser pump and body and out through the delivery orifice at the free end of the nozzle when the dispenser head or top is depressed as described above. After the desired amount of fluid is dispensed by depressing the dispenser head to actuate the pump. the user can stop depressing or pumping down (the dispenser pumping action) on the dispenser head to stop the fluid pumping action. Flow of the fluid out the nozzle orifice ceases when the pumping action is stopped. However, frequently some of the pumped fluid adheres to the end of the nozzle (retained fluid) about the delivery orifice and/or fluid in the nozzle fluid conduit connecting the dispenser pump to the nozzle orifice can leak out fluid in the conduit through the nozzle orifice (leaking fluid). Not infrequently this retained fluid and/or leaking fluid will drop or fall off the nozzle as a droplet. If the bottle of fluid is on a table or countertop, the fluid will fall from the end or tip of the nozzle onto the top of the table or counter. If the bottle is being carried when the fluid drips or drops off the nozzle, the fluid can fall to the floor. If the bottle is stored in a drawer or cabinet, the fluid can drop to the bottom of the drawer or on the shelf of the cabinet where the bottle is being stored. Depending upon the nature of the fluid in the bottle, the fluid can stain the surface it drops on. If can stain fabrics, such as the fabric of clothing, rugs, draperies and the like.

As explained immediately above when the pumping action is stopped the dispenser ceases delivery of fluid out of the bottle via the delivery orifice of the dispenser nozzle. But frequently retained fluid and/or leaking fluid remains at or adheres to the end of the nozzle about the delivery orifice. Depending upon the nature of the fluid, its solids content, and the relatively humidity of the ambient air surrounding the bottle, this fluid can frequently dry out and form a seal across the delivery orifice of the dispenser. The seal can be a relatively large hard or soft droplet or a film of dried fluid material across the delivery orifice. The seal can prevent dispensing of the fluid from the bottle or it can redirect the stream of fluid (redirected fluid) when the dispenser is depressed due to the seal only being partially separate from the orifice by the force of the fluid during the initial pump action. The redirected fluid can go in any direction and land on the floor, table top, counter top, the users clothing and the like. As mentioned above, the fluid can stain surfaces and fabric materials.

It would be desirable to have means for sealing off the delivery orifice of the dispenser's nozzle after use of the dispenser or during storage of a bottle with a delivery dispenser. It would accomplish two objectives. It would prevent leaking fluid from dripping out of the dispenser delivery orifice and it would prevent retained fluid and leaking fluid from dripping or dropping to the surface that the bottle is sitting on or the surface below the user holding or carrying the bottle with dispenser. It would also prevent the dispenser nozzle from being sealed off by dried or partially dried fluid material adhering to the delivery nozzle or the end of the nozzle about the delivery nozzle.

A nozzle cap would be one way to prevent the problems described the paragraph immediately above. Unfortunately, the cap presents its own issues. A simple cap that is just slide over the nozzle free end would probably be small and easy to lose or misplace. A lost or misplace nozzle cap means no cap and we are back to square one. The cap would probably be retained on the nozzle by a friction fit, that is the cap is retained on the nozzle by friction between the surface of the nozzle and the inner wall of the cap. The fluid itself might act as a lubricant and if the inner wall of the cap and/or the outer surface of the nozzle is at least partially wetted with the fluid, this fluid wetting might prevent the cap from remaining on the nozzle which is normally retained by a friction fit. If the cap is dropped and it contains fluid from the bottle, it can stain the surface it lands on. If the bottle with the dispenser and the cap are dropped, the cap might fly free since it is only retained on the nozzle by a friction fit and retained fluid would probably be projected of the nozzle tip when the bottle hits the might fluid might escape from the orifice of the nozzle.

Ideally the cap for the dispenser nozzle (nozzle cap) would be secured to the nozzle so it forms a seal preventing retained fluid leaking fluid from working its way off of or out of the nozzle, i.e., and out of the cap. Ideally such securing means could serve two functions. First it could ensure that the cap is always with the bottle. Secondly it ensures that the cap forms a good seal with the nozzle prevent fluid from leading out of the end of the cap and preventing air from entering the cap to such an extent that it dries the fluid and seals off the delivery orifice.

SUMMARY OF THE INVENTION

The present invention is directed to a cap for the fluid delivery nozzle of a pump action dispenser for fluid containers or storage containers comprising: A body having an exterior surface, a front end and back end, a chamber within the body, and an opening through the exterior surface into the chamber at the back end of the body, the opening and chamber adapted to receive the fluid delivery end of the nozzle; an arm having a first and second opposing ends, the first end of the arm extending back from the cap about the opening; and a ring adapted to be removably received on the head of the pump action liquid dispenser, the ring attached to the second end of the arm.

In a preferred embodiment of the invention, the cap is of one-piece construction.

In another preferred embodiment of the invention, the cap is made of an elastomeric material.

In another preferred embodiment of the invention the cap is made of an elastomeric material with a Shore durometer scale reading of about 50 to about 70 A.

In another preferred embodiment of the invention the cap is made of an elastomeric material with a Shore durometer scale reading of about 60 A.

In still another embodiment of the invention the cap is made of a material resistant to the chemical agents contained in the fluid dispersed by the pump action dispenser that the cap is used on. In a further embodiment of the invention the cap is made of a medical grade silicone rubber elastomer that (1) is chemically resistant to the fluid materials pumped with liquid dispensers, (2) has excellent heat resistant, (3) that is not swollen, softened or harden by the fluid materials pumped with liquid dispenser, (4) that is not leached by the fluid materials pumped with the liquid dispenser, and (5) has low permeability to gases such as oxygen, carbon dioxide, hydrogen sulfide and the like. In one preferred embodiment of the present invention the medical grade elastomer is a USP Class VI or ISO 10993 material.

DETAILED DESCRIPTION OF THE INVENTION

Referring to FIGS. 1-11, the cap 10 of the present invention has a body 12 connected to a first end of arm 14. The opposing second end of the arm 14 is connected to ring 16. In the preferred embodiment of the present invention the cap is molded in one piece. The body 12, arm 14 and ring 16 of the cap are molded together in one piece.

Preferably the cap is molded from an elastomeric material. Preferably in the Shore durometer scale, the elastomeric material has a value of about 55 to about 65 A and most preferably a value of about 60 A.

Lotions, soaps, cleaners, and the like have different chemical make ups and many of these chemicals can by absorbed by elastomers and effect their strength, durability and elastomeric properties. In the preferred embodiment of this invention, the elastomeric material used in the cap of the present invention is a silicone polymer or polysiloxane material, preferably a medical grade silicone rubber elastomer.

Figure 12:
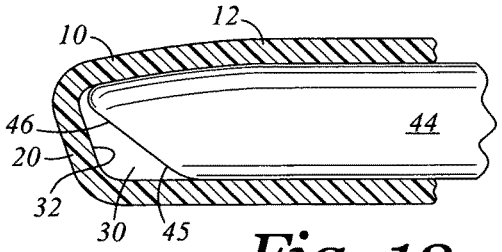
FIG. 12 is a partial cross-sectional view of the front-end portion of the body of the embodiment of FIG. 1 fitted on the free end of the delivery nozzle of a fluid dispenser.

The cap has a body 10 attached to the first end of an arm 14 and the back end 22 of the body. The second end of the arm 14 is attached to a ring 16. The arm is attached to the bottom side of the body 10 adjacent the opening 28 at the back end of the body. The opening 28 extends into the chamber 30 of the body. The chamber extends the full interior length of the body but is only open to the exterior of the body through opening 28. The opening 28 receives the free end of the delivery nozzle (also called the 'nozzle') 44 of the fluid dispenser 40 (See FIGS. 2 & 12). The ring or strap of the cap (described below) is received on the neck 42 of the fluid dispenser 40.

When the body has somewhat of a triangular shape when viewed from the top side or bottom side (See FIGS. 1 and 8-11) to receive the free end of those nozzles that have somewhat of a triangular when viewed from the top or bottom side. The triangular shape is preferred, but the body can have a rectangular shape, a square shape, an oval shape with a back end similar to the back end of body 12, or a half-rounded shape (see FIGS. 23-24 and 37-28). The front end 20 of the body 12 is sealed off. The back end 22 of the body has a rib like structure (rib) 26 that encircles the opening 28 to increase the structural integrity of the opening which receives 7 the nozzle. The rib is optional, but preferred. In the embodiment shown the rib 26 has a circular cross section. Other geometrical cross-sections, such as ovals or triangular or rectangular shapes, can also be used. The arm 14 extends out of the rib 26 on the bottom side 23 of the body. Although the arm can extend out of the top of the body, it is preferred that the arm extend out of the bottom of body because that design aids in keeping the ring on the head of the dispenser (see FIG. 2).

The arm connects the ring 16 to the body and separates the ring 16 from the body 12. However, the cap can be made with the body and ring alone without the arm (not shown). In the latter case, the ring would be attached directly to the rib 26. In still another embodiment, the ring would extend out of the body on either side of the opening 28 forming a U-shaped structure (FIGS. 23-24). In the latter design, the back end of the body would be part of the U-shaped ring structure.

Figure 1:
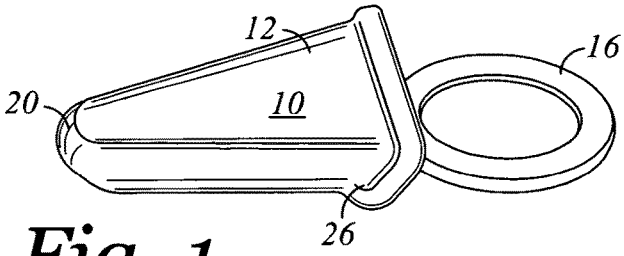
FIG. 1 is a top perspective photo view of a preferred embodiment of the present invention.
Figure 2:
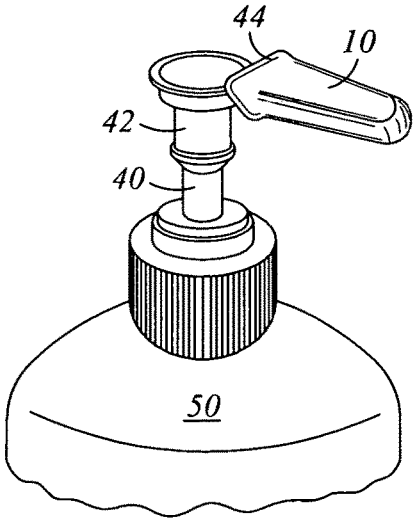
FIG. 2 is a top perspective view of application of the FIG. 1 embodiment of the present invention to a pump dispenser secured to a storage bottle for fluid.
Figure 3:
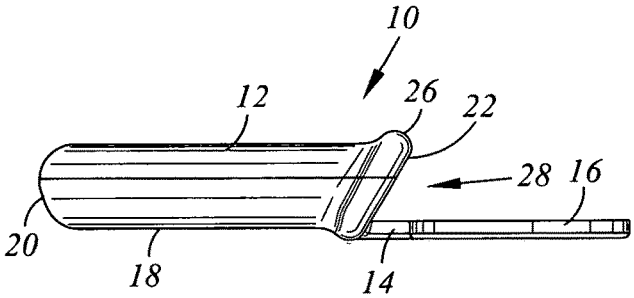
FIG. 3 is a side view of the embodiment of FIG. 1.
Figure 4:
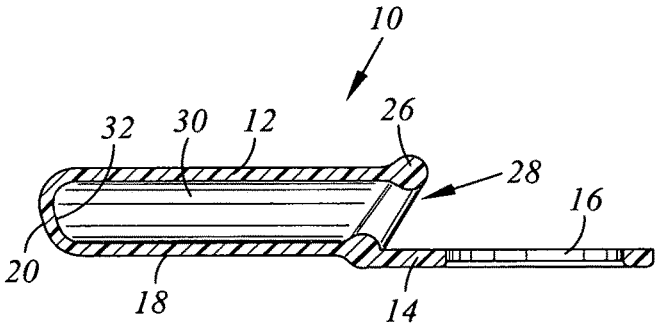
FIG. 4 is a cross-sectional view of the invention shown in FIG. 3.
Figure 5:
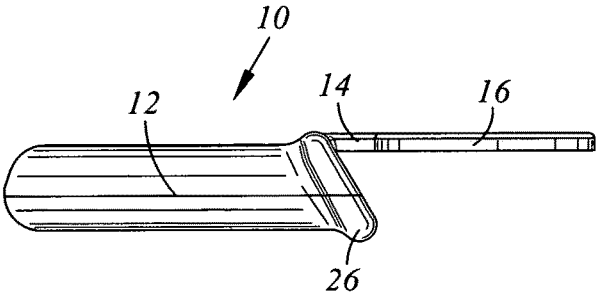
FIG. 5 is a side view of the embodiment of FIG. 1.
Figure 6:
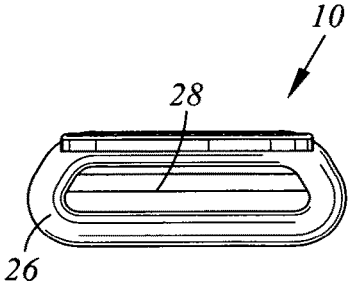
FIG. 6 is a rear view of the embodiment shown in FIG. 1.
Figure 7:
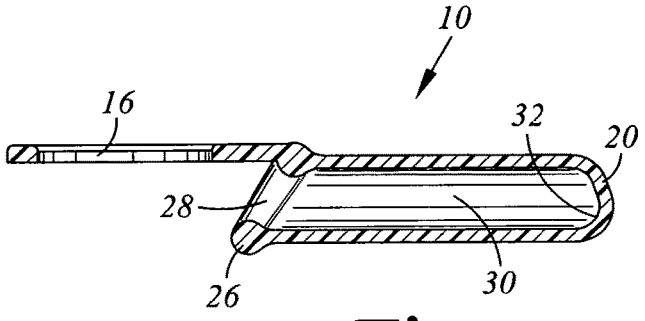
FIG. 7 is a cross-sectional view of the invention shown in FIG. 5.
Figure 13:
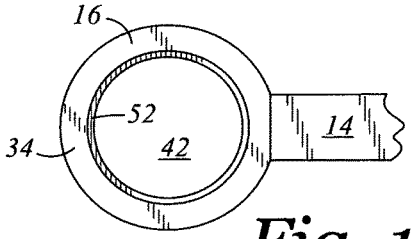
FIG. 13 is a cross-sectional of the ring emplaced around the head of a dispenser.

The ring 16 is designed to slip over the nozzle, around the top of the head of the dispenser and reside around the head of the dispenser (see FIGS. 2 and 13). The ring retains the cap on the dispenser when the cap is removed from the nozzle. The cap is removed from the nozzle when it is desired to dispense fluid from the storage bottle or container 50 (FIG. 2). The cap is removed by pulling the body forward until the back end 22 of the body clears the free end or tip 54 of the nozzle and the body is then moved so the opening 28 is away from the end of the nozzle. The body can be released and since the whole cap is made of elastomeric polymer, the body and the opening will be pulled back toward the ring 28 and away from the end of the nozzle Of course if the opening 28 is aligned with the tip of the nozzle when the body is released, body will probably slip back onto the nozzle. The front interior end 32 of the chamber 30 can engage the delivery orifice of some nozzles and seal the orifice off. However, some delivery orifices are set back at the end of the nozzles of some dispenser pumps. The body seas off the delivery orifice of such nozzles by coming in sealing contact with the outer surface of the nozzle, normally near the end of the nozzle. This seals off the delivery orifice indirectly, but effectively.

Figure 8:
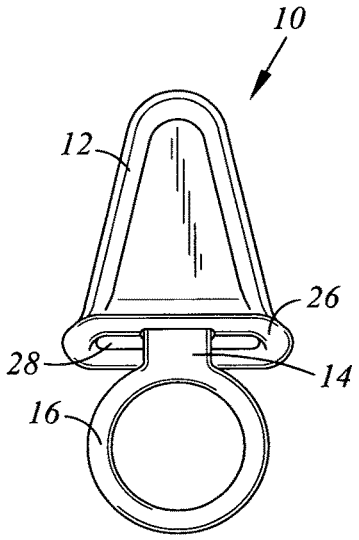
FIG. 8 is a top view of the embodiment of FIG. 1.
Figure 9:
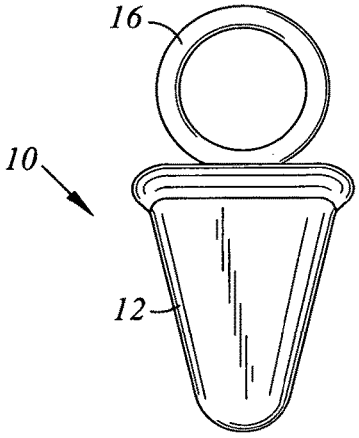
FIG. 9 is a bottom view of the embodiment shown in FIG. 1.
Figure 10:
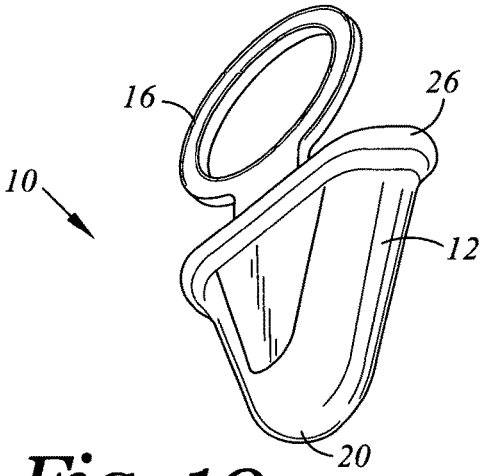
FIG. 10 is a bottom rear photo view of the embodiment of FIG. 1.
Figure 11:
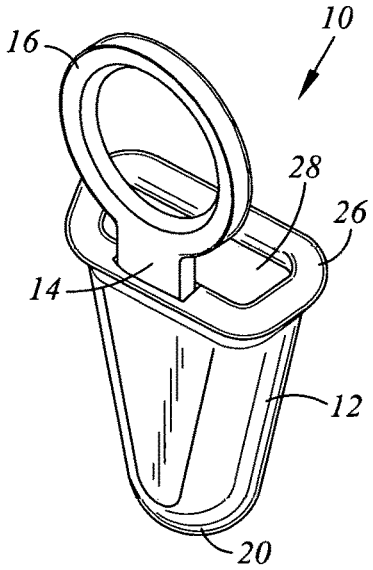
FIG. 11 is a top rear photo view of the embodiment of FIG. 1.
Figure 14:
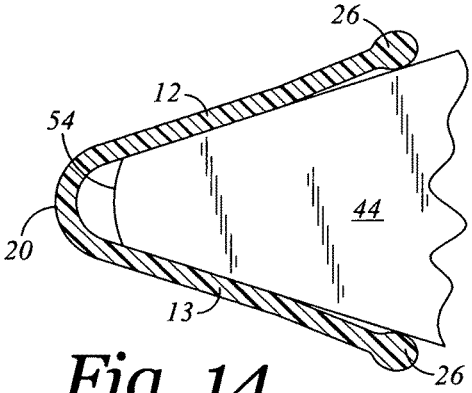
FIG. 14 is partial cross-sectional view of the cap with the profile of a nozzle in the body.
Figure 15:
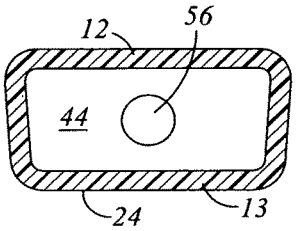
FIG. 15 is a cross-sectional view of the body with a nozzle taken along lines 15-15 of FIG. 14.

As mentioned above although several manufacturers produce dispensers, the size and shapes of their dispensers, and especially the nozzles, are very similar. Many of the dispenser nozzles available on the market have been measured and almost all measure about 1¼ inches from the center of the dispenser neck 42 (see FIG. 2) to the free end or tip 45 of the nozzle 44 and measure about 1½ inches from that portion of the back of the dispenser neck 42 to the free end or tip 45 of the nozzle. It has been found that if the body of the cap is triangular shape as shown in FIGS. 8-9 and 14 with a length of about 0.9 to about 1.2 inches with a back opening of about 0.5 to about 0.7 inches in width and a height of about 1.1 to about 1.35 inches and a front width in front of the curved end wall of about 0.25 to about 0.35 inches, that the cap will effectively seal off the delivery orifices of the nozzles of most dispenser pumps presently available The chamber 30 height can be uniform the full length of the chamber or it can be slanted or angled down from the opening 28 to the front end of the body. The inventive cap has been found to fit on all commercial dispenser pumps available to date and to seal the nozzles when fitted on the dispenser pump nozzles. The cap was tested on the all the dispensers the inventor was able to locate. The opening 28 into the cap chamber 30 is slanted. It can be vertical, but it is preferred to be slanted around 25 to 65 degrees backward from the perpendicular toward the ring 16 from the bottom side of the body to ease placement of the cap body on a nozzle and to ease removal of the body from a nozzle.

The distance from the inner surface of the back side 52 of the ring 16 (See FIG. 13) to the front interior wall 32 of the body (See FIGS. 4, 7 & 13) is preferably slightly less than the distance from the tip or free end of the nozzle 44 to the back side of the head 42 of the pump dispenser. A distance of about 1.5 inches from the backside of the ring to the front interior wall of the body has been found suitable. However, it can be less than 1.5 inches, such as about 1.4 inches.

The cap is preferably made of elastomeric material as described above. To install the cap on a pump dispenser, the ring 16 of the cap is slid down the nozzle and fitted around the head 42 of the dispenser 40 usually below the juncture of the nozzle width the dispenser. The body of the cap is then pulled away from the dispenser. The elastomeric material of the cap 8 allows this. The free end 45 of the nozzle is slipped into the opening 28 of the body 12 of the cap. The free end portion of the nozzle slips into the chamber 30 of the cap until the free end 45 of the nozzle is near or comes in contact with the inner wall of the chamber usually at the front closed end 32 of the chamber. As mentioned above, the body can effectively seal the delivery orifice of the nozzle by having the outer surface of the nozzle in full sealing contact with the inner wall completely around the nozzle. The cap distance from the inner end wall 32 of the body to the back inner side 34 of the ring 16 is shorter than the distance from the tip 54 of the nozzle and the back side of the dispenser head 52 so that the cap is taunt when fitted on the dispenser with the ring 16 of the cap attached to the head 42 and the body 12 of the cap fitted over the nozzle 44. This ensures that the inner wall of the chamber 30 contacts the nozzle's outer surface near the tip 45 of the nozzle and seals the wall of the chamber near the inner end wall 30 around the delivery orifice of nozzle preventing fluid leakage from the nozzle leaking out of the chamber and preventing air circulation to the tip of the nozzle and about the delivery orifice 46.

The body 12 of the cap is easily slid off the nozzle to allow use of the dispenser. To remove the cap from the dispenser, the body of the cap is slid off the nozzle and the ring is worked off the head of the nozzle and slid down and off the nozzle.

The cap is molded in one piece from a rubber type elastomer that is resistant to water and organic materials. Preferably the elastomer is a medical grade silicone rubber elastomer. A number of manufacturers supply medical grade rubber elastomers including Apple Rubber Products, Inc. having offices in Lancaster, New York (www.applierubber-.com). Medical grade rubber elastomers are preferred because of their chemical resistance, heat resistance and low permeability to gases. As described above, pump dispensers are used for many chemical compositions containing oil, organic chemical solvents, health associated chemicals and aqueous solutions. Many of these compositions can seep through, dissolve, and interact with many elastomers. Medical grade silicone rubber elastomers are very resistant to such materials and the cap made from such elastomers retains its shape, is not affected by such materials and prevents contamination from outside agents which might penetrate through other types of elastomers. As mentioned, medical grade silicone rubber elastomer is the preferred material of construction for the cap 10. Such elastomers resists swelling, softening or hardening from the chemicals in the fluid material. In addition, such elastomers resist such fluid material from dissolving chemicals out of the elastomer that could contaminate the fluid material.

As mentioned earlier the cap can be fitted to most commercial liquid pump dispensers available in today's market. The reason for that is that the size of the dispenser heads and nozzle widths and lengths are similar in size and shape. We have found that a body around 28 mm in length and about 22 mm in width at in back end, with a chamber opening at the back end of around 20 mm by 4.5 mm and a camber front end of around 4 mm by 4.5 mm will fit the nozzle of most liquid pump dispensers. and effectively seal off the front end and the delivery nozzle at the front end of the nozzle. The nozzle is slightly larger than the body chamber but the elastomeric nature of the body permits it to be easily received on the nozzle to seal the front end. The back of the body is angled around 60 degrees, but it can be perpendicular or angled up to 30 degrees from the bottom of the body towards the front of the body. The ring 16 has an outer diameter of about 16 mm and an inner diameter of about 13 mm. However, the ring can be larger, such as having an outer diameter of about 16 to 20 mm and an inner of diameter of about 13 to 15 mm or it can be smaller with an outer diameter of about 14 to 16 mm or in inner diameter of about 11 to 13 mm. Preferably the thickness of the ring elastomeric material is at least 1 mm in horizontal width and vertical thickness. The external length of the cap from the tip of the front of the body to the rear of the ring can be from about 40 to about 50 mm and preferably about 44 mm. The thickness of the wall of the body can be from about 0.5 to about 2 mm and preferably about 1 mm.

Figure 16:
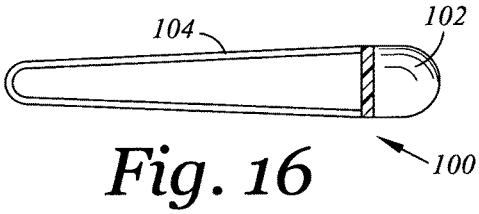
FIG. 16 is a top view of an alternative embodiment of the present invention.

Alternative embodiments of the cap of the present invention are depicted in FIGS. 16-19. Referring to FIG. 16, the cap 100 has a hemispherical cover 102 which can be received on the front of the nozzle of the fluid dispenser pump. The cover is held in place by strap 104 which is received on the dispenser head. The cover has a hemispherical chamber to receive the head of the nozzle and the head of the nozzle and/or the delivery orifice of the nozzle seal against the inner wall of the cover when the cap is placed over the head of the nozzle. The cap 100 is made of the elastomeric mater described above. The overall length of the cap 100 is about 1.5 inches. The strap 104 is about 0.05 inches thick and about 0.1 inches wide. The cover 102 is about 0.3 inches in length and about 0.35 inches in width. The wall thickness of the cover is about 0.05 inches. The length of the cap and the size of the cover and/or strap can be less than or greater than these dimensions.

Figure 17:
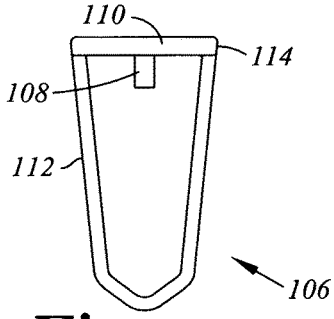
FIG. 17 is a top view of another embodiment of the present invention.
Figure 18:
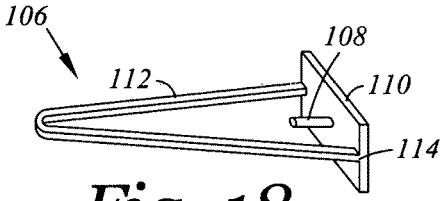
FIG. 18 is a perspective view of the embodiment of FIG. 17.

Referring to FIGS. 17-18, the illustrated cap 106 has a plug 108 which can be inserted into the delivery orifice of the fluid dispenser nozzle. The plug 108 is about 0.15 inches in length and it can be a constant diameter cylinder plug with a diameter of about 0.1 inches or a tapered plug with the end having a diameter of about 0.1 inches and a base diameter of about 0.15 inches. The plug 108 extends out of the back side of the plate 110 which is connected to strap 112 at its outer sides 114. The plug after insertion into the nozzle orifice is held in place by strap 112, strap 112 is similar to strap 104 of the cap 10 described above. The plug closes off the delivery nozzle of the fluid dispenser to prevent leakage from the delivery nozzle. The plate 110 can be rectangular in shape as shown in FIG. 18, or it can be square shape, oval or circular disc shape or the like (not shown). The plate bends around the front surface of the nozzle. The cap 106 is made of the medical grade silicone rubber elastomeric material described above. The overall length of the cap 106 is about 1.5 inches. The strap 104 is about 0.05 inches thick and about 0.1 inches wide. length. The plate 110 is about 0.25 inches wide and about 0.35 inches wide. The length and thickness of the strap 112 and the diameter and length of the plug 108 and the size of the plate 110 can be less than or greater than these dimensions. The cap is molded in one piece and the elastomer can be easily stretched to accommodate a large variety of dispenser pumps with different dimensions and shapes.

Figure 19:
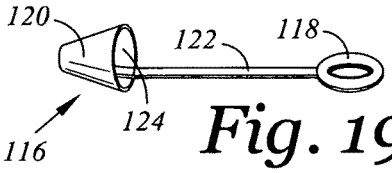
FIG. 19 is a perspective view of a further embodiment of the present. invention.

Referring to FIG. 19, the cap 116 is similar in many respects to the cap 10 described above. The cap 116 has a ring 118 and body 120. The ring 118 and the body 120 are secured together with a strap 122. The body 120 is shorter than the body 12 of cap 10. The body is conical shape with a conical chamber 124 opened at the end of the body facing the ring 118. The chamber 124 of the body is adapted to receive the front section of a nozzle vis its opening 124. The front end of a nozzle, including the delivery orifice, of a fluid dispenser are received in the chamber 124 of the body 120 to seal the front end of the nozzle including its orifice as described above. The body is about 0.3 inches in length and has an outer diameter of about 0.3 inches at its opening 124. The front of the body has an outer diameter of about 0.2 inches. The wall thickness of the body is about 0.05 inches. The ring 118 has an outer diameter of about 0.3 inches and an inner diameter of about 0.25 inches with a wall thickness of about 0.05 inches. The ring 118 is similar in construction to the ring 16 described above but smaller. The rings 16 and 118 can be smaller because of the elastic properties of the medical grade silicone rubber elastomer that the caps 10 and 116 are made of. The cap 116 is made of the elastomeric mater described above to permit the ring 118 to be worked down the nozzle and over the head of the dispenser onto the dispenser neck 42 (FIG. 2). The overall length of the cap 116 is about 1.5 inches. The strap 122 is about 0.05 inches thick and about 0.1 inches wide. The length and diameter of the cap and the size of the cover, ring and/or strap can be less than or greater than these dimensions.

The medical grade silicone rubber elastomers that the caps of the present invention are molded from is very elastic and can be stretched easily two-fold without tearing or permanently deforming the caps or parts thereof. This permits a single size cap, such as cap 10, to be utilized on a large variety of dispenser pumps of varying size and shape. Although the distance of most dispenser pumps from the back side of the head of the dispenser to the tip of the dispenser nozzle are around 1.5 inches plus or minus about 0.2 inches, the present cap has been successfully used on dispensers with long nozzles where the distance from the back side of head of the dispense to the tip of the nozzle is about 4 inches, and it can be utilized on fluid dispensers measuring at least about 1.5 inches from the back side of the fluid dispenser neck 44 to the front end of the dispenser nozzle.

The invention claimed is:

1. A cap for a nozzle of a fluid dispenser, the cap comprising:

an elongated enclosed body with an enclosed front end and an opposing back end with an opening, the body having a central chamber extending from the opening in the back end to the front end, the body adapted to be received on the nozzle of the fluid dispenser;

a ring assembly extending from the back end of the body and adapted to be received by a neck of the fluid dispenser to draw the body of the cap over the nozzle of the fluid dispenser; and the cap fabricated from a stretchable material.

2. The cap according to claim 1 wherein the ring has a front side and a back side, and an arm that connects the front side of the ring to the back end of the body.

3. The cap according to claim 2 wherein a first cross sectional area of the chamber at the back end of the body is at least twice a second cross sectional area of the chamber at the front end of the body.

4. The cap according to claim 2 wherein the distance from a front wall of the chamber to the inner side of the ring assembly at the back side of the ring assembly is less than 1¼ inches.

5. The cap according to claim 2, wherein a rib surrounds the opening and the arm is attached to the rib.

6. The cap according to claim 1 wherein the horizontal width of the chamber is less than ⅜ inches.

7. The cap according to claim 1 wherein the vertical height of the chamber is less than ¼ inches.

8. The cap according to claim 1 wherein the stretchable material is an elastomeric polymer has a Shore durometer scale reading of about 50 to about 70 A.

9. The cap according to claim 1, wherein the body is attachable onto and removable from the nozzle while the ring remains in place around the neck without tearing or permanently deforming the cap or part thereof.

10. The cap according to claim 1, further including a plug inside the chamber at the front end, the plug configured to be inserted into a delivery orifice of the nozzle when the body resides over the nozzle.

11. The cap according to claim 1, wherein the body of the cap is held taunt against a tip of the nozzle when the body is residing on the nozzle and pulled towards the ring attached around the neck.

12. The cap according to claim 1, wherein, when the body of the cap is fitted on the nozzle and the ring attached around a neck of the dispenser, a front wall of the central chamber contacts the nozzle near a tip of the nozzle and seals the front wall of the chamber against a delivery orifice of nozzle.

13. The cap according to claim 1, wherein the stretchable material is an elastomeric polymer.

14. The cap according to claim 1, wherein the stretchable material may be stretched two-fold without tearing or permanently deforming the caps or parts thereof.

15. The cap according to claim 1, wherein the cap is configured to be removable from the original position on the nozzle and replaceable to the original position on the nozzle without damage to the cap.

16. The cap according to claim 1, wherein the cap is configured to be removable from the original position on the nozzle leaving the ring in place around the neck, and replaceable to the original position on the nozzle without damage to the cap.

17. The cap according to claim 1, wherein the cap is made from silicone polymer or polysiloxane material or a medical grade silicone rubber elastomer.

18. The cap according to claim 1, wherein the body is removed from the nozzle by pulling the body forward until the back end of the body clears a tip the nozzle without removing the ring from the neck.

19. A cap for a nozzle of a fluid dispenser, the cap comprising:

an elongated enclosed body with an front end and an opposing back end with an opening, the body having a central chamber extending from the opening in the back end to the front end, the body adapted to be received on the nozzle of the fluid dispenser;

a ring assembly extending from the back end of the body and adapted to be received around a neck of the fluid dispenser to draw the body of the cap over the nozzle of the fluid dispenser; and the cap is fabricated from an elastic material wherein the elastic material may be stretched pulling the body forward until the back end of the body clears a tip the nozzle without removing the ring from the neck and without tearing or permanently deforming the cap or part thereof.

20. A cap for a nozzle of a fluid dispenser, the cap comprising:

an elongated enclosed body with an front end and an opposing back end with an opening, the body having a central chamber extending from the opening in the back end to the front end, the body adapted to be received on the nozzle of the fluid dispenser;

a ring assembly extending from the back end of the body and adapted to be received around a neck of the fluid dispenser to draw the body of the cap over the nozzle of the fluid dispenser; and the cap is fabricated from an elastic material wherein the elastic material may be stretched and the body removed from the nozzle by pulling the body forward until the back end of the body clears a tip the nozzle without removing the ring from the neck and without tearing or permanently deforming the cap or part thereof.

* * * * *